US007011132B2

(12) United States Patent
Robbins, III

(10) Patent No.: US 7,011,132 B2
(45) Date of Patent: Mar. 14, 2006

(54) STRIP CURTAIN SUPPORT SYSTEM

(76) Inventor: Edward S. Robbins, III, 128 Hazelwood La., Florence, AL (US) 35630

( * ) Notice: Subject to any disclaimer, the term of this patent is extended or adjusted under 35 U.S.C. 154(b) by 205 days.

(21) Appl. No.: 10/474,175

(22) PCT Filed: Feb. 27, 2003

(86) PCT No.: PCT/US03/05964

§ 371 (c)(1),
(2), (4) Date: Oct. 2, 2003

(87) PCT Pub. No.: WO03/075722

PCT Pub. Date: Sep. 18, 2003

(65) Prior Publication Data

US 2004/0159411 A1 Aug. 19, 2004

Related U.S. Application Data

(60) Provisional application No. 60/361,671, filed on Mar. 4, 2002.

(51) Int. Cl.
*A47H 1/00* (2006.01)

(52) U.S. Cl. ..... 160/332; 160/184; 411/400

(58) Field of Classification Search ..... 160/332, 160/330, 184, 196.1, 404; 211/57.1, 59.1, 211/60.1; 248/220.31, 71; 411/512, 401, 411/400

See application file for complete search history.

(56) References Cited

U.S. PATENT DOCUMENTS

| | | | | | |
|---|---|---|---|---|---|
| 2,136,168 | A | * | 11/1938 | Kern | 211/47 |
| 3,452,959 | A | * | 7/1969 | Ishikawa | 248/488 |
| 4,095,642 | A | | 6/1978 | McKinnon et al. | |
| 4,165,778 | A | | 8/1979 | Smith | |
| 4,232,725 | A | | 11/1980 | Gidge | |
| 4,257,471 | A | | 3/1981 | Thurmond, Jr. | |
| 4,289,190 | A | | 9/1981 | Catan | |
| 4,312,396 | A | | 1/1982 | McKinnon et al. | |
| 4,335,777 | A | | 6/1982 | Simon | |
| 4,340,106 | A | | 7/1982 | Van Horn, II | |
| 4,355,678 | A | | 10/1982 | Romano | |
| 4,367,781 | A | | 1/1983 | Vallieres, Jr. et al. | |
| 4,384,606 | A | | 5/1983 | Johnston et al. | |
| 4,388,961 | A | | 6/1983 | Schaefer et al. | |
| 4,449,270 | A | | 5/1984 | Brabant | |
| 4,454,904 | A | | 6/1984 | Oxman | |
| 4,515,202 | A | | 5/1985 | Wilson | |
| 4,607,678 | A | * | 8/1986 | Pomaville et al. | 160/332 |
| 4,776,382 | A | | 10/1988 | Rooswinkel | |
| 4,805,784 | A | * | 2/1989 | Solheim et al. | 211/94.01 |
| 4,852,628 | A | | 8/1989 | Klein | |
| 5,127,460 | A | * | 7/1992 | Abadi et al. | 160/332 |
| 5,146,971 | A | * | 9/1992 | McCarty | 160/184 |
| 5,450,890 | A | | 9/1995 | Pinkalla et al. | |
| 5,520,237 | A | | 5/1996 | Finkelstein et al. | |
| 6,050,322 | A | | 4/2000 | Finkelstein et al. | |
| 6,213,437 | B1 | | 4/2001 | Robbins | |
| 6,264,046 | B1 | * | 7/2001 | Ford | 211/59.1 |
| 6,394,171 | B1 | | 5/2002 | Robbins, III | |
| 6,474,983 | B1 | | 11/2002 | Robbins | |

* cited by examiner

*Primary Examiner*—David Purol
(74) *Attorney, Agent, or Firm*—Brinks Hofer Gilson Lione

(57) ABSTRACT

An environmental strip curtain holding apparatus for suspending a plurality of flexible transparent strips forming a curtain includes a bar suitable for mounting to fixed structure adjacent to a location requiring the presence of a strip curtain. A plurality of pegs are coupled to the bar, each peg including a stalk extending outwardly from the bar. A cap is fixed to a distal end of the stalk spaced by a pre-selected distance from the bar. Each cap is generally symmetric with respect to the stalk to which the cap is fixed and has an outermost edge that is ovate to circular. The outermost edge of the cap is sized greater than the stalk to which the cap is fixed and greater than supporting holes in the strips forming the strip curtain. The distal outer surface of the cap diminishes in size from the outermost edge of the cap toward a distal extremity of the cap in such a way as to facilitate the elastic stretching of the holes in each strip to a size sufficient to permit the strip to be forced over the outermost edge of the cap.

47 Claims, 9 Drawing Sheets

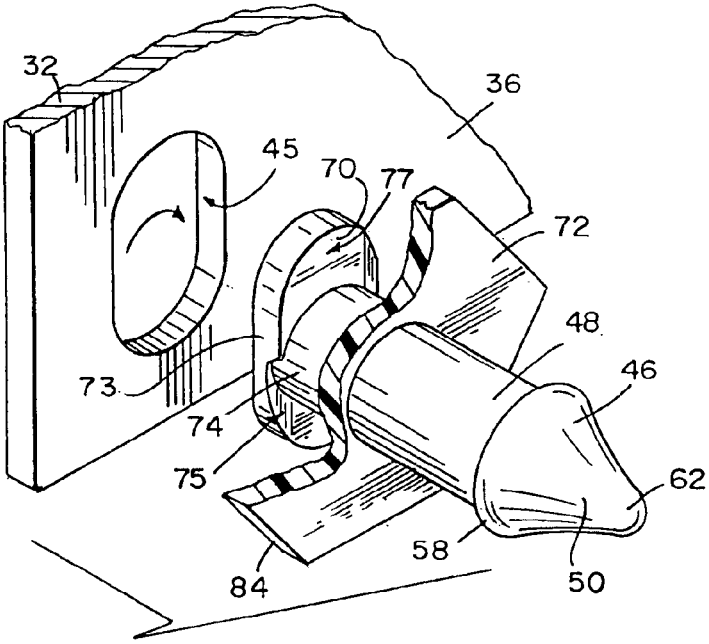
FIG. 20
FIG. 25
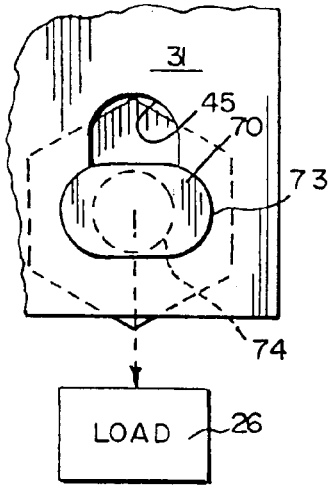
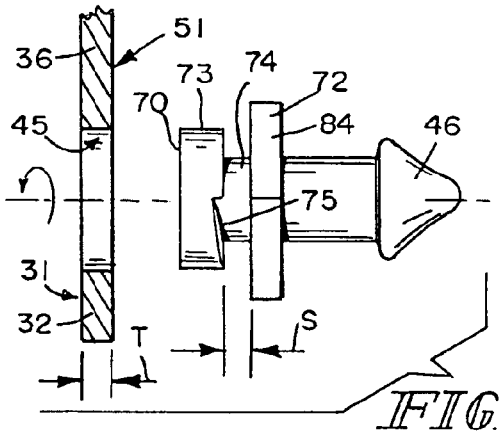
FIG. 21
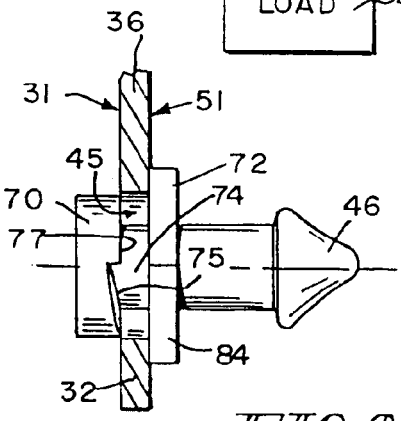
FIG. 22
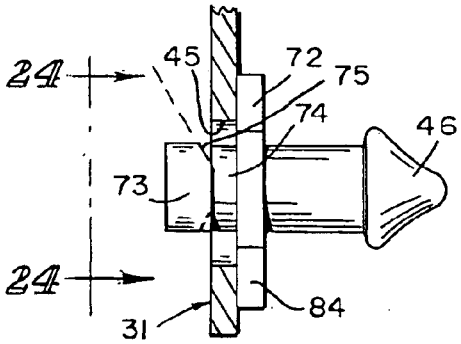
FIG. 23
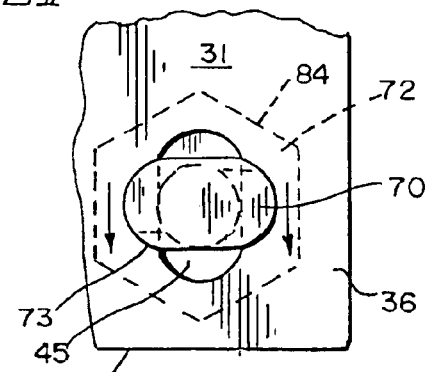
FIG. 24

STRIP CURTAIN SUPPORT SYSTEM

CROSS-REFERENCE TO RELATED APPLICATIONS

This application is related to U.S. provisional patent application Ser. No. 60/361,671 filed Mar. 4, 2002.

BACKGROUND OF THE INVENTION

The present invention pertains generally to industrial curtains used as environmental closures for openings through which traffic can still pass. The curtains generally comprise a plurality of usually transparent strips that are suspended contiguously to each other from a hanger or support generally fixed adjacent to a top margin of the opening. Each of the strips usually consists of a length of flexible, generally transparent, material terminating adjacent to a lower margin of the opening. The present invention relates particularly to an improved support from which the industrial strip curtain can be suspended.

Industrial curtains are conventionally employed to provide closures between, for example, separate manufacturing areas within large buildings, warehouses and the like. Goods are often required to be transported from one area of a manufacturing or storage facility to another where one or the other of the areas is heated, air-conditioned or even refrigerated. Sometime other environmental concerns need to be addressed such as dust, fumes, smoke, dirt, or even noise. Where the traffic is only occasional, conventional doors can be employed to close any doorway between the two areas. Where the traffic is considerable, the use of conventional doors gives way to suspended flexible screens or curtains, which inhibit the wholesale transfer of air from one area to the other yet still permit goods-transporting vehicles to pass through with little effort.

These curtains are generally made up of side-by-side elongated plastic strips that hang from a support system mounted to extend across the top of the opening. For safety reasons, it is desirable that the curtain be sufficiently transparent that one operating a transporting vehicle be able to see any hazard or obstruction that might exist on an opposite side of a curtain before proceeding through. Persons on the opposite side of a curtain also desire to be able to see oncoming transport vehicles so appropriate evasive action can be taken. Thus, plastic materials, which were more or less transparent, such as polyvinyl chloride and polyethylene, were adopted as the preferred materials for forming such screens as shown, for example, in U.S. Pat. Nos. 4,095,642, 4,165,778, 4,232,725, and 4,607,678.

Many different support systems have been developed for these strip curtains. One type of support system involves each strip forming the curtain having a loop for receiving a horizontal rod that is mounted adjacent to the top of the opening covered by the curtain by two or more brackets. Examples of this type of support system are disclosed in U.S. Pat. Nos. 4,095,642; 4,384,606; 4,515,202; and 6,213,437. A related type of support system is disclosed in U.S. Pat. Nos. 4,257,471 and 4,776,382 wherein the loops at the top of each strip are formed by separate structural hangers that loop over the horizontal rod and are coupled to each strip forming the curtain. A common disadvantage of such support systems is the tendency for the horizontal rod to sag between supports, which can cause an uneven hang to the strips forming the curtain.

To avoid this disadvantage, some much more complicated hanger schemes have been devised as shown in U.S. Pat. Nos. 4,312,396; 4,335,777; 4,340,106; 4,388,961; 5,146,971; 5,520,237; and 6,050,322 that commonly use extruded profiles or similar structures that are secured adjacent to the top of the opening to be covered by the curtain. The extruded profiles are design to mate with other formed hanger members coupled to the strips forming the curtain. None of these systems have gained wide acceptance, perhaps due to the time involved in assembly of the curtain strips to the hangers and the occasionally awkward engagement between the hangers and the supporting profiles or equivalent structures. Much more simple structures are to be found in U.S. Pat. Nos. 4,165,778; 4,232,725, 4,289,190; and 4,607,678 that disclose a series of threaded fasteners such as a bolts or the like penetrating a series of holes located in the upper ends of each strip. Mating fasteners are engaged on the bolts over the strips to hold the strips in place. The assembly of such structures has been found to be a very time-consuming, repetitive activity, which is often not completed in an entirely satisfactory way, thus leading to later disengagement by the mating fasteners causing the strips to fall away from the support system.

A strip curtain support system that permits fast and easy assembly is disclosed in U.S. Pat. No. 5,127,460. The support comprises a bar having a series of pegs spaced equidistance from each other along the length of the bar. Each peg includes a leg extending substantially perpendicularly outward from the bar. A foot is fixed to each leg so that each foot extends downwardly perpendicular to the stalk and is spaced from the bar. The strips forming the curtain have multiple holes near the top of each strip, which are spaced the same distance from each other as the distance between the pegs. The strips can be suspended from a plurality of the pegs by manipulating the multiple holes upward over the feet and onto the leg portion of each peg. Unfortunately, the downwardly projecting portion of each foot acts, over time, as a lever pressed by the moving curtain that flexes the base of each leg adjacent to the strip upward and downward to such an extent that the support fails by the leg breaking away from the supporting bar.

Accordingly, what is needed is a strong strip curtain support system that allows for fast and easy assembly, yet is sufficiently strong that product failure due to flexing or any other action is unlikely to occur. What is further needed is such a strip curtain support system that permits the curtain strips to be easily changed when the strips become worn or abraded, or for other reasons need moved.

SUMMARY OF THE INVENTION

A strip curtain support of the present invention is intended for use in an environmental strip curtain system that is typically employed for at least partially obstructing a passage through a wall. The strip curtain generally has a plurality of flexible transparent strips suspended for the curtain support. Each strip of the curtain includes a plurality of holes of a selected size located adjacent to an upper end of the strip. The strip curtain support of the present invention can include a bar, and mounting elements for mounting the bar to fixed structure adjacent to the passage to be obstructed by the curtain. The mounting elements can be in the form of fasteners adapted to pass through holes or slots in the bar to fasten the bar to the wall or ceiling above the passage. The strip curtain support also includes a plurality of pegs that can be coupled to the bar. Each peg includes an outwardly extending stalk portion that can extend outwardly from the bar. The stalk portion of each peg is generally linear and perpendicular to the bar, however in some circumstances the stalks can be curved so long as the stalks are generally parallel to each other and curve in the same direction and to the same extent. The stalks generally include a curved upper surface. The curved upper surface can form a portion of a cylindrical stalk or tapered stalk.

Each stalk has a proximal end typically connected to the bar and a distal end including a cap spaced by a pre-selected distance from the proximal end of each stalk. The proximal end of each stalk can be fixed to the bar by fastening, staging, welding, casting or molding. The proximal end of each stalk can also be directly fixed to a supporting surface by fastening with either a separate or an integral fastener, in which case the bar can be omitted. Alternatively, the proximal end of each stalk can be received in a slot in bar that can provide for some small variation in alignment of the holes in the strips, or allow for gravitational alignment of the strips even when the bar is not mounted to a supporting surface in a true horizontal manner. When the bar includes a series of slots to receive the proximal ends of the stalks, the slots can include an upper portion that is larger is size than a lowest portion to allow for insertion of the pegs during assembly. In a preferred embodiment each slot includes an angular path between the larger sized portion and the lowest portion so that displacement of the pegs from the slots while a curtain is suspended thereon is rendered nearly impossible.

Each cap, which is located on the distal end of a stalk, is generally symmetric with respect to the stalk to which the cap is fixed. An outermost edge of the cap ranges from ovate to a circle having an outer maximum dimension or diameter greater than the diameter of the holes in the strip to be mounted on the strip curtain support. The diameter of the outermost edge of the cap can be from about 1.2 to about 1.7 times the diameter of the holes in the strip, and is preferably about 1.5 times the diameter of the holes in the strip. The diameter of the stalk generally approximates the diameter of the holes in the strip, although some variation in size will not prevent the combination of the strip curtain and the support from performing satisfactorily.

A distal outer surface of the cap has a shape facilitating the stretching of the holes of each strip to a size sufficient to permit the strip to be forced over the outermost edge of the cap. In a preferred embodiment, the distal outer surface of each cap comprises a substantially conical surface extending from a distal extremity of the cap to the outermost edge of the cap. Alternative embodiments for the distal outer surface of each cap include a mushroom-shape and can include a substantially hemispherical shape extending from a distal extremity of the cap to the outermost edge of the cap.

A proximal surface of the cap extending between the outermost edge of the cap and the stalk to which the cap is fixed is resistant to removal of the strip curtain from the curtain support under normal usage. The proximal surface of the cap can be planar and perpendicular to the stalk, but preferably includes a smooth outer edge to prevent a cutting action on the curtain strips. The proximal surface can also be concave, but is preferably slightly convex. The proximal surface of each cap is spaced from the supporting bar by a distance at least equal to twice the thickness of the strips to be mounted on the curtain support. Preferably, the proximal surface of each cap is spaced from the supporting bar by a distance equal to about five times the thickness of the strips.

One feature of the present invention is an environmental strip curtain system that allows for easy installation of the strips by providing distal surfaces on the peg caps causing a temporary stretching of the material forming the strips immediately surrounding each hole provided at the upper end of the strips. Thus, the curtain strips can be mounted to the pegs on the curtain support by merely pushing the strips onto the pegs with sufficient force to cause the necessary stretching of the material forming the strips.

Another feature of the present invention is an environmental strip curtain system which inhibits any accidental removal of the strips, yet allows for easy replacement of one or more strips by providing caps that are integral with the stalks, rather than screw fasteners that can loosen when subjected to normal vibration and jarring, and by providing proximal surfaces to the caps that do not encourage displacement of the strips past the caps, yet permit replacement of the strips by merely pulling on the strips with sufficient force to again stretch the material forming the strips enough to allow the cap to pass through the holes formed in the strips. By selecting the cap size and hole size appropriately, assuming a known make-up of the materials forming the strips, the removal force can be chosen to be in a range that will realistically prevent any accidental strip removal during normal use.

Additional features and advantages of an environmental strip curtain support system of the present invention will become apparent to those skilled in the art from a consideration of the following discussion of preferred embodiments of the present invention that include the best mode of carrying out the invention as present perceived. The following discussion references the accompanying drawings.

BRIEF DESCRIPTION OF THE DRAWINGS

FIG. 20 is an exploded perspective view of another embodiment prior to assembly of the peg to the bar.

FIG. 21 is an exploded view partially in section of the assembly shown in FIG. 20.

FIG. 22 is a view partially in section of the assembly shown in FIG. 21 immediately after assembly.

FIG. 23 is a view similar to FIG. 22 after rotation of the peg with respect to the bar.

FIG. 24 is a rear elevation view of the assembly shown in FIG. 23 taken in the direction of arrows on line 24—24.

FIG. 25 is a rear elevation view similar to FIG. 24 upon application of a load such as a curtain strip.

DESCRIPTION OF PREFERRED EMBODIMENTS

Figure 1:
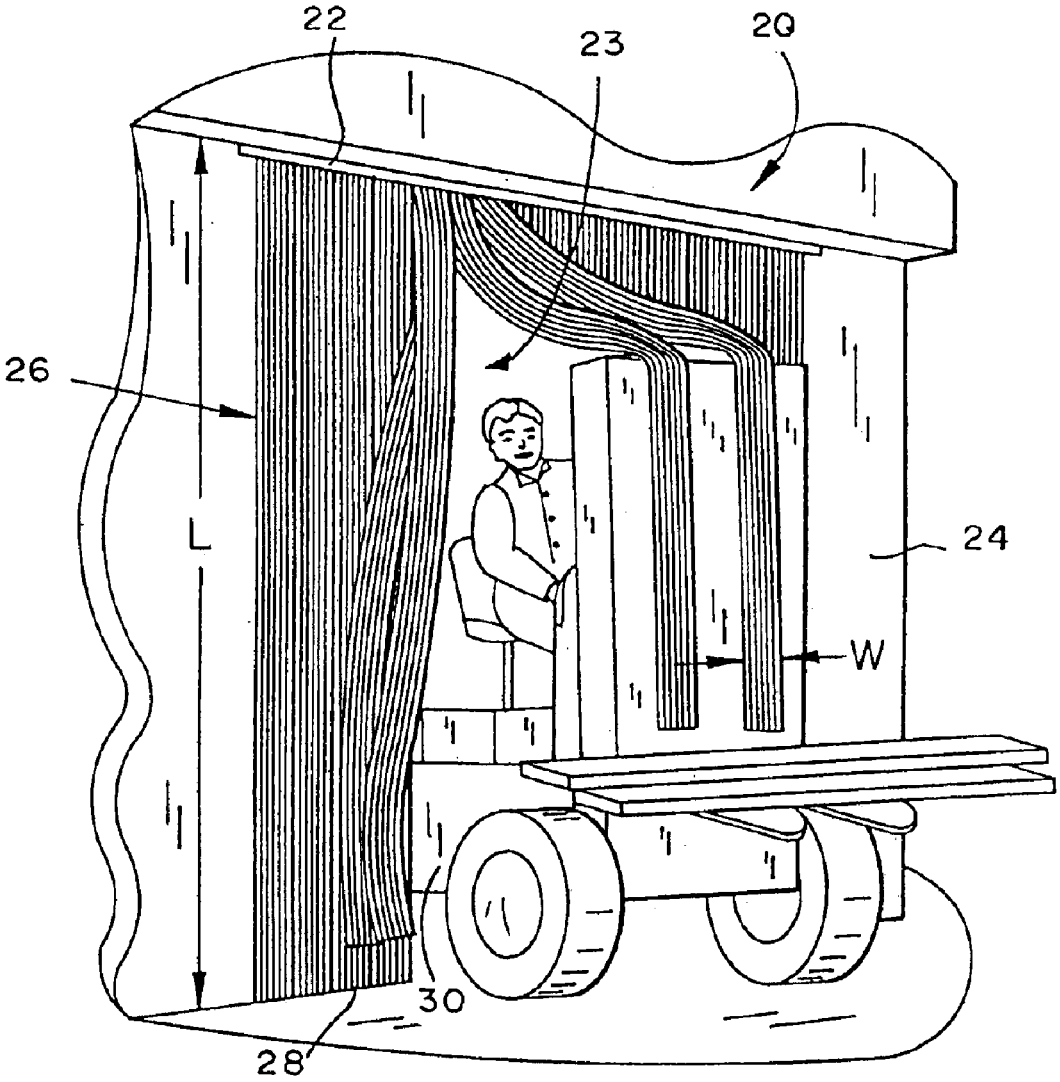
FIG. 1 is a perspective view of an environmental strip curtain system that can employ a curtain supporting structure of the present invention.

FIG. 1 shows a perspective view of an environmental strip curtain system 20 that incorporates a curtain holding apparatus 22 of the present invention. The curtain holding apparatus 22 is fixed adjacent a passage 23 through a wall 24. The strip curtain system 20 includes a strip curtain 26 consisting essentially of a plurality of flexible transparent strips 28, each strip of width W and length L suspended on the curtain holding apparatus 22 of the present invention, usually in an overlapping pattern. The strips 28 are sufficiently flexible that transportation vehicles 30 can move through the passage 23 through wall 24 by displacing the strips 28 as shown in FIG. 1. The general nature and use of such environmental curtain systems 20 are well known, and the present invention is directed at the new curtain holding apparatus 22 upon which the strips 28 are suspended so as to at least partially obstruct the passage 23 through wall 24.

Figure 2:
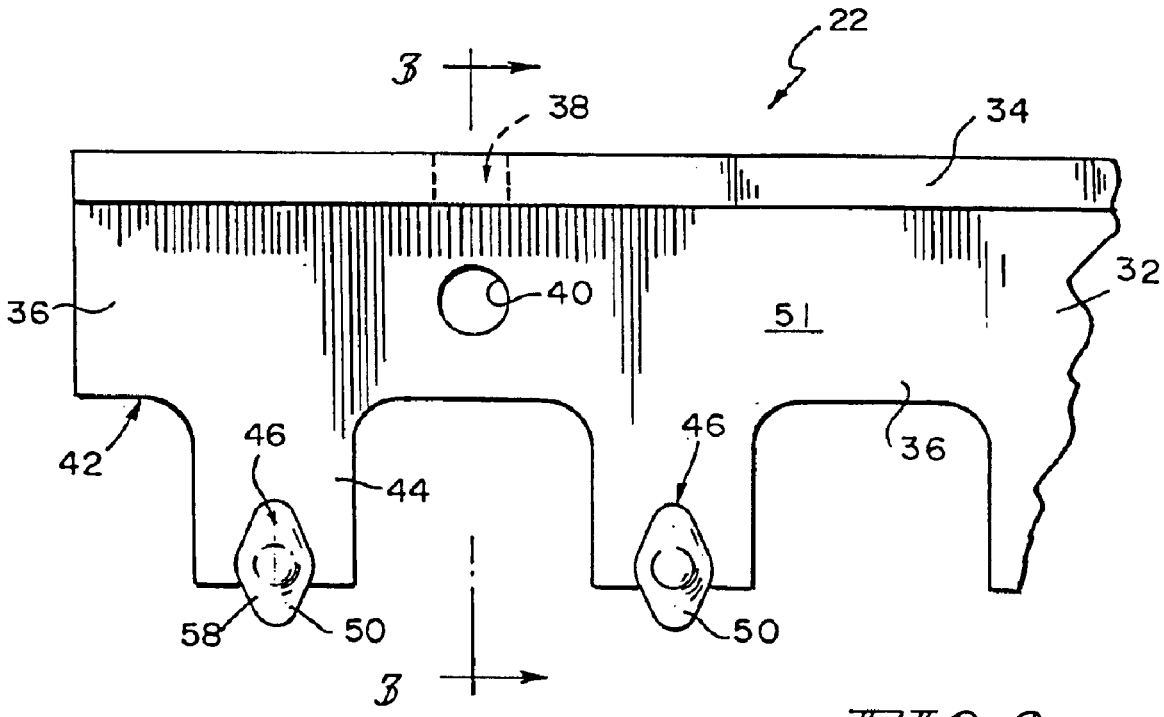
FIG. 2 is a front elevation view of a first embodiment of the present invention.
Figure 3:
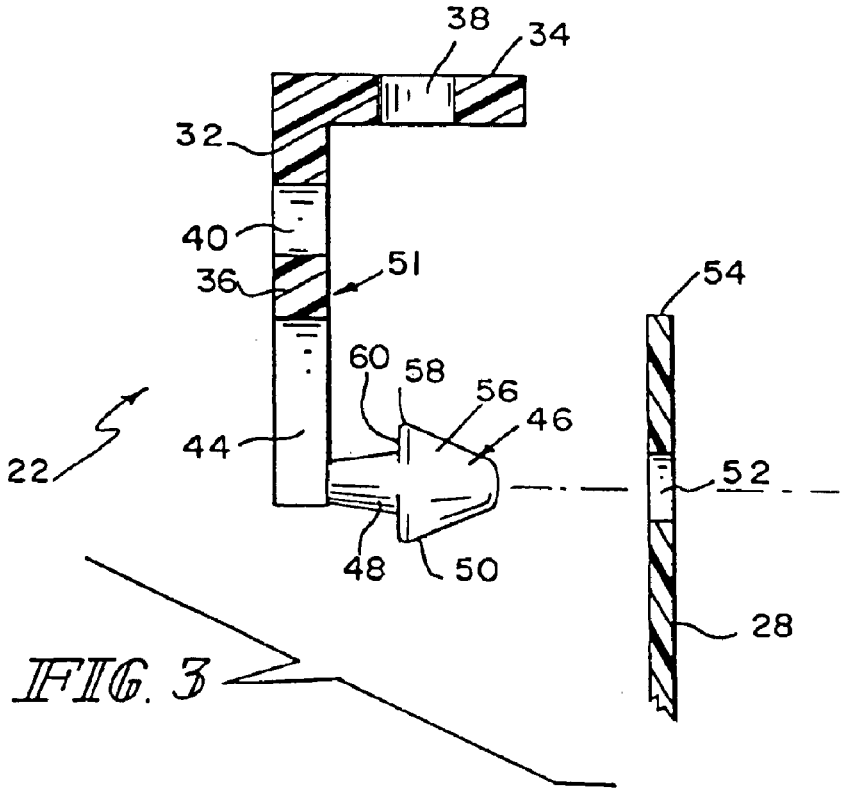
FIG. 3 is a sectional view of the embodiment shown in FIG. 2 taken along line 3—3.

A first embodiment of the curtain holding apparatus 22 of the present invention is shown in FIGS. 2 and 3 to comprise an inverted L-shaped bar 32 having an upper, generally horizontal portion 34 and a lower, vertical portion 36, which are shown to be made of a molded plastic. The upper portion 34 includes openings 38 while the lower portion 36 includes openings 40. The openings 38 and 40 are suitable to receive bolts, screws, or other fasteners for fastening the curtain holding apparatus 22 to the wall 24 or other fixed structure adjacent to a passage 23 sought to be protected by a strip curtain system 20. The bar 32 has a lower margin 42 that includes a series of downward projections 44. A peg 46 is fixed to a front surface 51 of the downward projection 44 and projects outward from the downward portion 36 in a nearly horizontal relationship that is substantially parallel to the upper portion 34. The peg 46 includes a stalk portion 48 and a cap portion 50. The stalk portion 48 is shown to be tapered but is otherwise circular in cross-section. The cap 50 is also shown to be tapered but in the reverse direction from the taper shown on stalk portion 48 and is shown in FIG. 2 to be essentially ovate or elliptical.

A representative strip 28 is also shown in cross-section in FIG. 3 to include a hole 52 near the upper margin 54 of the strip. As will be noted, the size of the hole 52 is approximately the same as the size of the stalk 48 and smaller than the largest dimension of the cap portion 50. The strip 28 can be installed on peg 46 by pushing the strip 28 over the cap portion 50 with sufficient force as to elastically deform the hole 52. The cap 50 includes a distal surface 56 that is tapered to facilitate the stretching of the hole 52 to a size sufficient to permit the strip 28 to be forced over the outermost edge 58 of the cap 50 and onto the stalk 48 where the hole 52 elastically returns to its original size. The more abrupt character of the essentially perpendicular proximal surface 60 of cap 50 inhibits the reverse process from occurring under the conditions normally prevalent during use of a strip curtain 26 as an environmental barrier in a passageway or doorway 23 through a wall 24.

Figure 4:
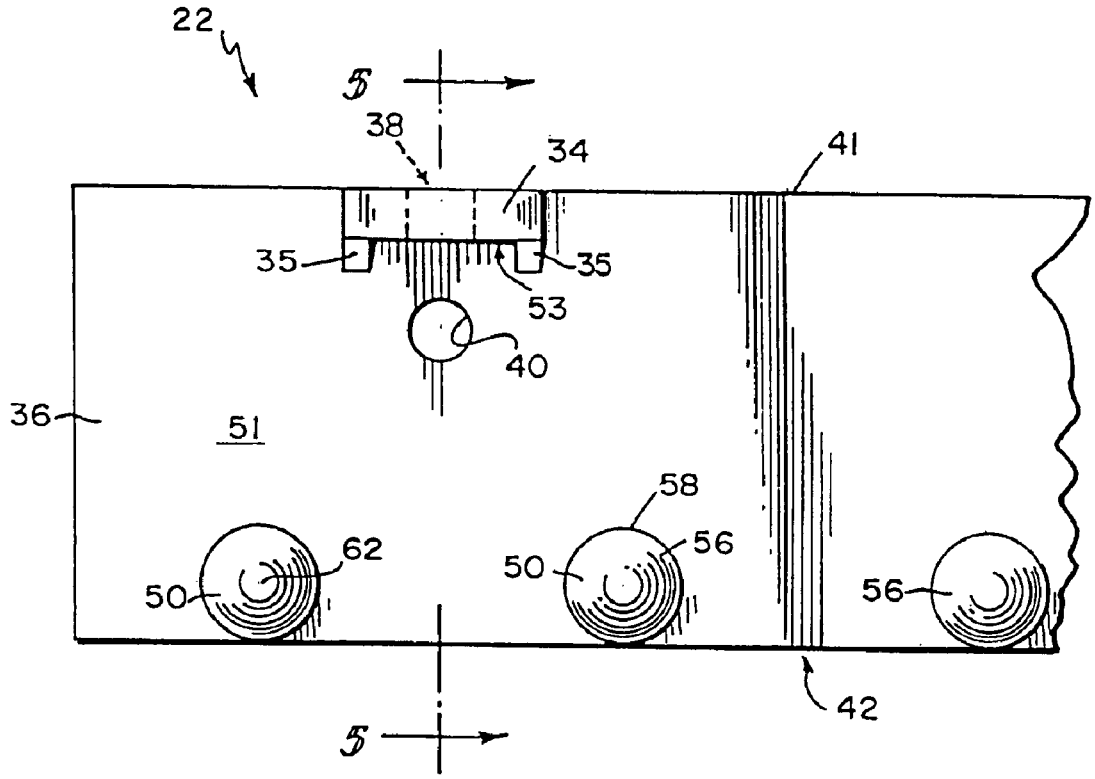
FIG. 4 is a front elevation view of a second embodiment of the present invention.
Figure 5:
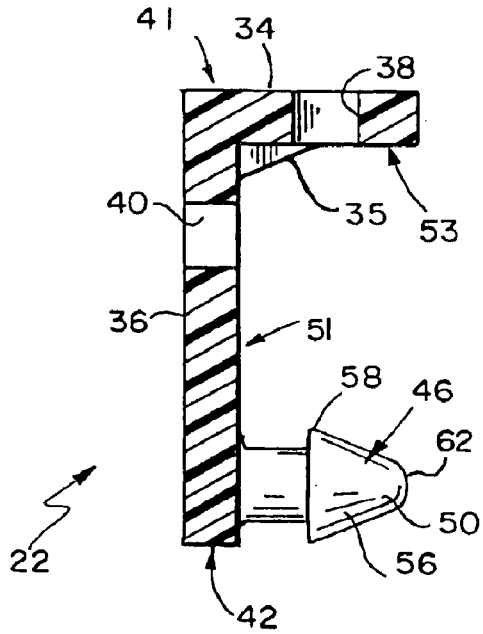
FIG. 5 is a sectional view of the embodiment shown in FIG. 4 taken along line 5—5.
Figure 4A:
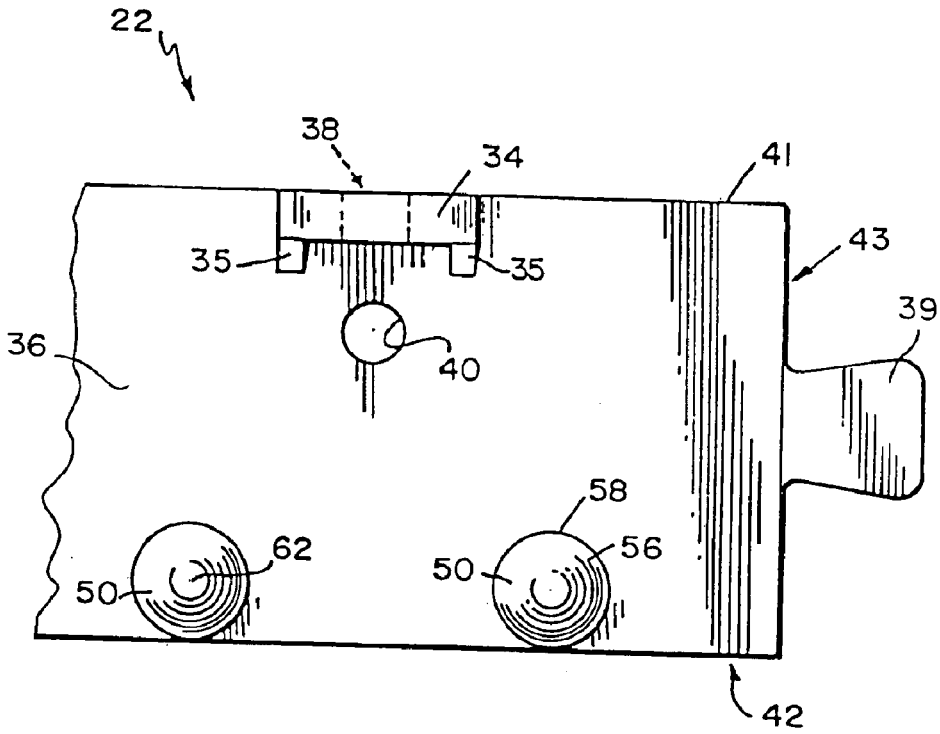
FIG. 4A is a front elevation view of a variation on the second embodiment of the present invention.
Figure 5A:
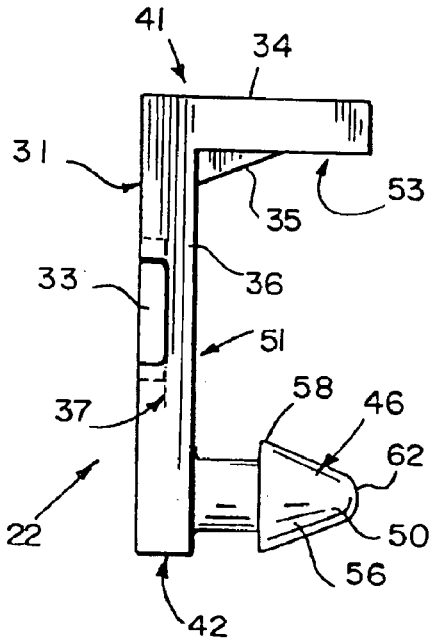
FIG. 5A is an end elevation view of the variation shown in FIG. 4A taken from the left end of FIG. 4A.
Figure 5B:
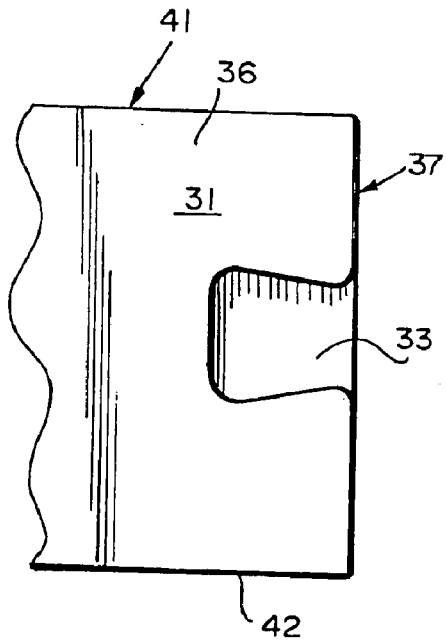
FIG. 5B is a back elevation view of an end portion of the variation shown in FIGS. 4A and 5A.

A second embodiment of a curtain holding apparatus 22 of the present invention is shown in FIGS. 4 and 5 to be a unitary cast or molded work piece, which can be made of a variety of high strength polymers such as a polyacetal, ABS, PEEK, polyamide, and others. In this second embodiment, the lower vertical portion 36 is shown to have a continuous, linear lower margin 42 and a continuous linear upper margin 41. The upper horizontal portion 34 is shown as merely a short segment joined to the lower vertical portion 36 by webs 35 extending from the front surface 51 to the lower surface 53 of the upper horizontal portion 34 that reinforce the angular relationship between the upper portion 34 and lower portion 36. The pegs 46 are shown to include an outermost edge 58 that is circular. The distal surface 56 of cap 50 is essentially a truncated cone extending forward from the outermost edge 58 to a distal end portion 62. A variation of this second embodiment is shown in FIGS. 4A, 5A and 5B. A first end 43 of the lower vertical portion 36, shown in FIG. 4A, includes a projecting tab 39 that projects from a rearward portion of the lower vertical portion 36. An opposite or second end 37 of the lower vertical portion 36 includes a slot 33 in the rear surface 31 of bar 32, the slot 33 being sized and shaped to receive a similar tab 39 of an adjacent bar 32. While the shape of the tab 39 and slot 33 are shown to be generally trapezoidal, the exact shape is subject to some choice of design and need not be as illustrated. The cooperating tab 39 and slot 33, taken together with the surfaces of the ends 43 and 37 operate to align adjacent bars 32 with each other. It will be appreciated that the bars 32 can be of any convenient length, and the lengths of all bars 32 need not be identical.

Figure 6:
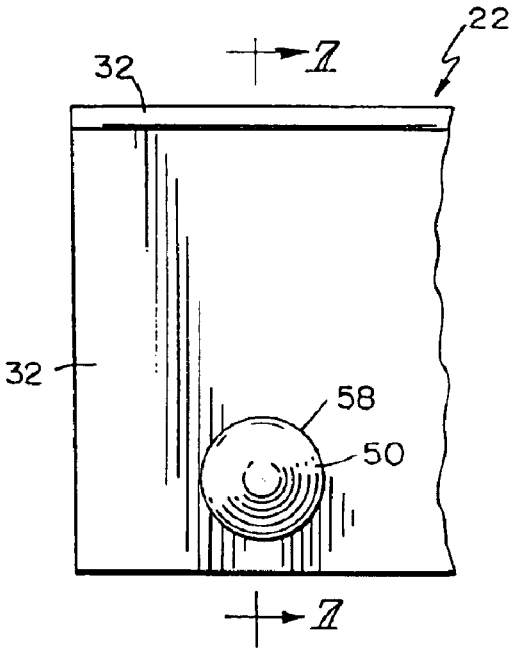
FIG. 6 is a front elevation view of a third embodiment of the present invention.
Figure 7:
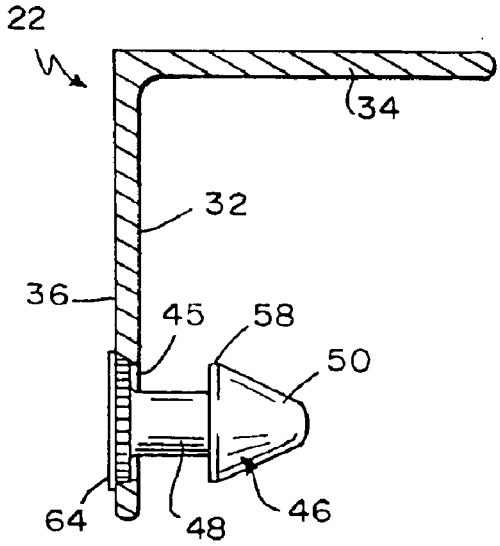
FIG. 7 is a sectional view of the embodiment shown in FIG. 6 taken along line 7—7.

FIGS. 6 and 7 show yet another embodiment of a curtain holding apparatus of the present invention wherein the bar 32 is formed of an extruded aluminum. A series of openings 45 are formed in the lower, vertical portion 36 which are sized to receive a base 64 of peg 46. The base 64 of each peg is swaged into the opening 45 so that the peg 46 is fixed with respect to the lower, vertical portion 36. Openings similar to openings 38 and 40 shown in the prior embodiments can be included in the portions 36 and 34 of the bar 32 so that the bar can be secured to either a wall or an overhead fixed structure. The outermost edge 58 of the cap 50 is sized to pass through the opening 45 prior to the staging operation.

Figure 8:
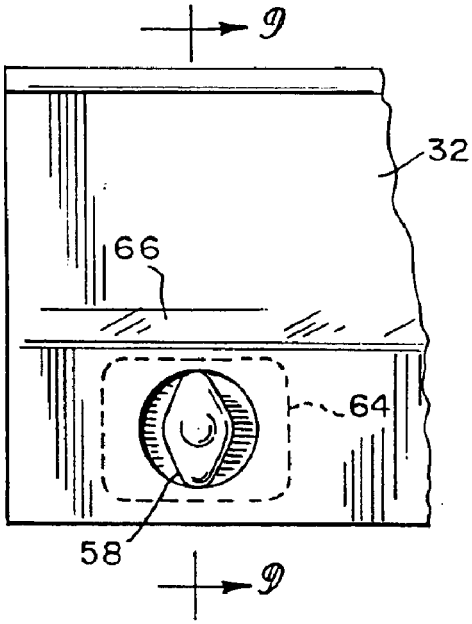
FIG. 8 is a front elevation view of a fourth embodiment of the present invention.
Figure 9:
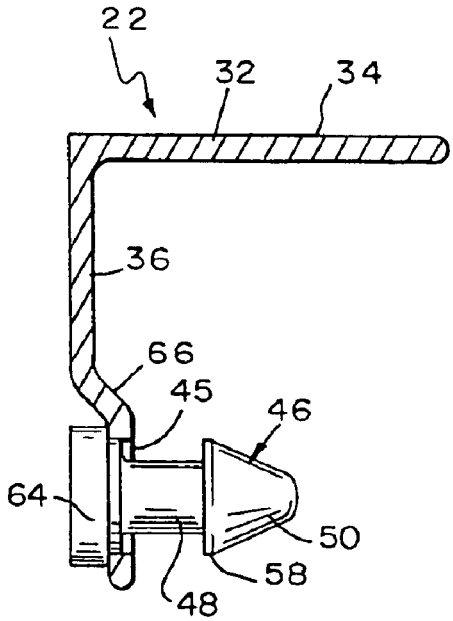
FIG. 9 is a sectional view of the embodiment shown in FIG. 8 taken along line 9—9.

Yet another embodiment of the curtain holding apparatus 22 of the present invention is shown in FIGS. 8 and 9 and are similar in construction to that shown in FIGS. 6 and 7, however, the lower vertical portion 36 of bar 32 includes an offset portion 66. The offset portion 66 permits a more substantial base 64 to be employed to support the peg 46. The margin of base 64 is shown in FIG. 8 in phantom to be rectangular. The outermost edge 58 of the cap 50 to be oval or elliptical with the larger dimension being about the same size as the opening 45 while the smaller dimension is much closer to the diameter of the stalk portion 48. While the base 64 can be secured through a staging operation, the more substantial base 64 also permits the base 64 to be welded to the vertical portion 32.

Figure 10:
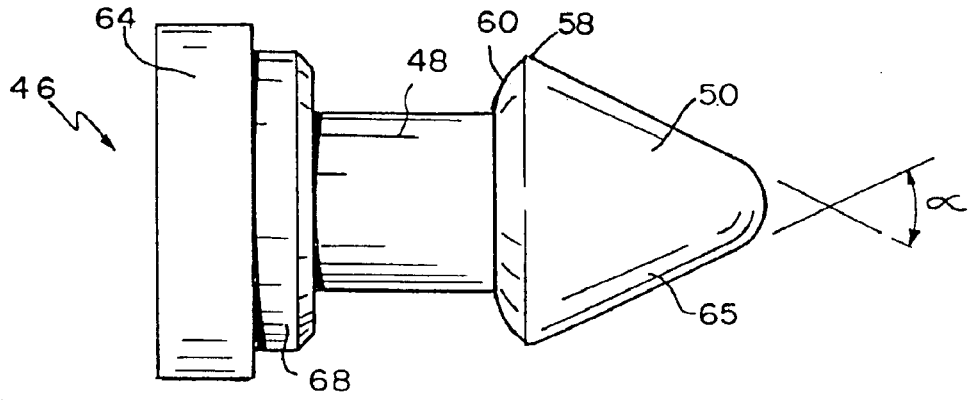
FIG. 10 is a side elevation view of a peg suitable for use in various embodiments of the present invention.
Figure 11:
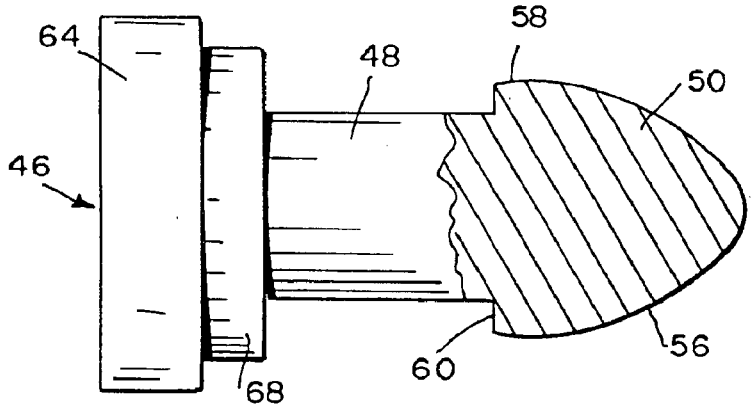
FIG. 11 is a side elevation view of another peg suitable for use in various embodiments of the present invention.
Figure 12:
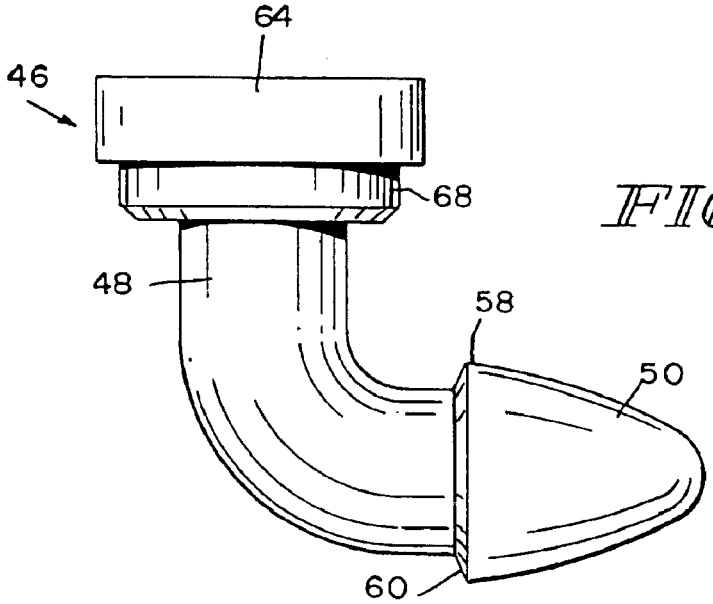
FIG. 12 is a side elevation view of yet another peg suitable for use in various embodiments of the present invention.

FIGS. 10 through 12 illustrate in detail three embodiments for the pegs usable in bars of the present invention. Each of the pegs is shown to include a base 64. A stepped portion 68 is sized to be received in an opening 45 in the bar 32. The embodiments shown in FIGS. 10 and 11 are suitable for use, for example, in the bar 22 shown in FIGS. 8 and 9. The embodiment shown in FIG. 12 can also be used in the bar 32 shown in FIGS. 8 and 9, but with the bar 32 re-oriented so that the openings 45 are in the upper horizontal portion 34 rather than the vertical lower portion 36. The pegs 46 of FIG. 12 can also be used in strictly a linear bar adapted to be fixed to a ceiling or overhead margin of an passageway 23 thereby eliminating the need for any lower vertical portion 36.

The pegs 46 of FIGS. 10 through 12 all include a stalk portion 40, which is smaller than the outermost edge 58 of the corresponding cap 50. The cap 50 shown in FIG. 10 includes a proximal surface 60 that is convex while the proximal surface 60 of the embodiment shown in FIG. 11 is concave. The proximal surface 60 in FIG. 12 is formed by a linear taper. The distal surface 56 of FIGS. 11 and 12 have a rounded taper similar to a mushroom cap and can be thought of semi-elliptical in cross-section. The distal surface 56 of FIG. 10 is substantially conical with an apex angle a of the cone being approximately 50°.

Figure 13:
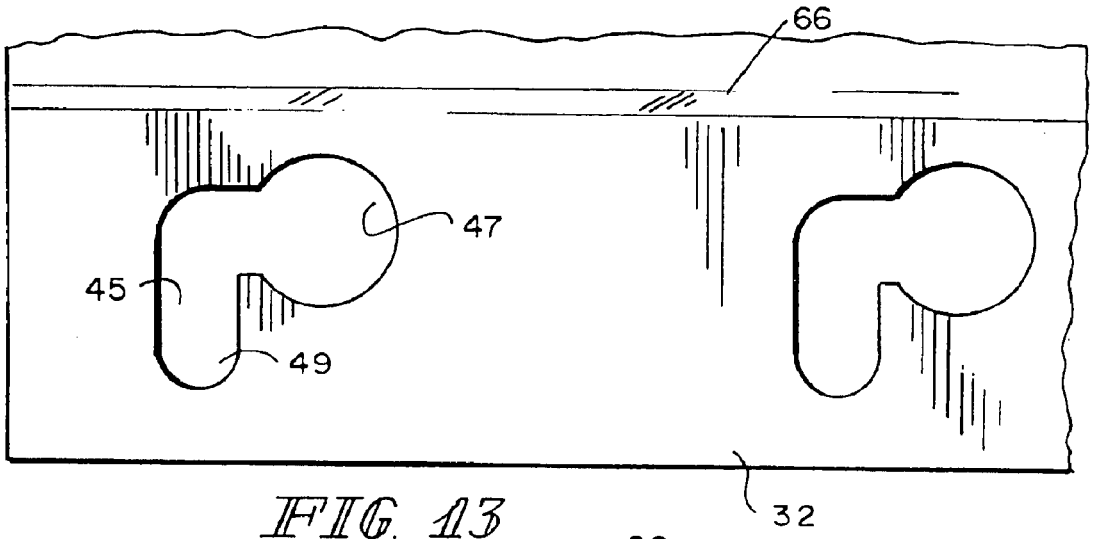
FIG. 13 is a front elevation of a bar suitable for use in the present invention.
Figure 14:
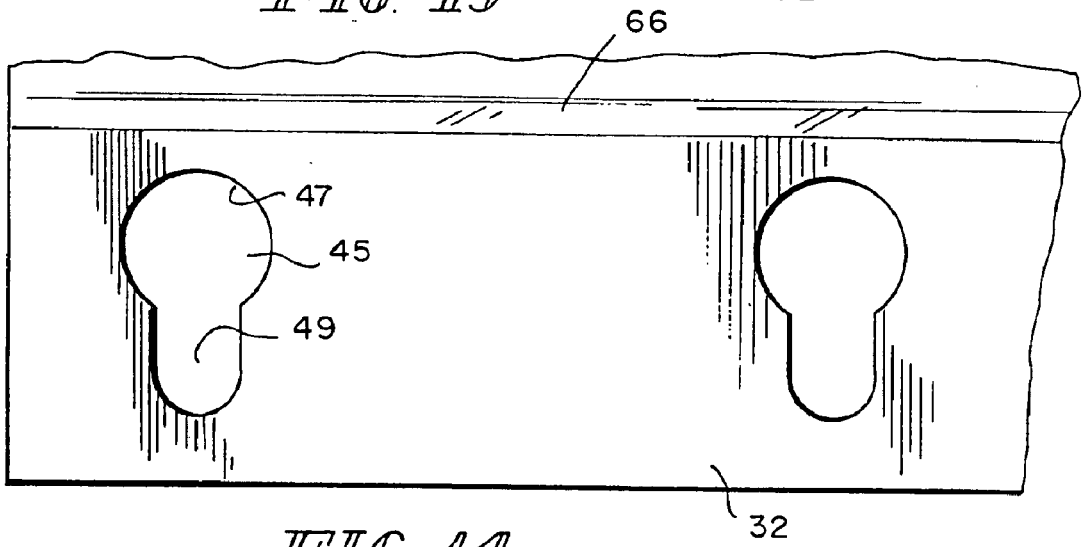
FIG. 14 is a front elevation of another bar suitable for use in the present invention.

Two further embodiments of a bar 32 suitable for use in a curtain holding apparatus of the present invention are shown in FIGS. 13 and 14. The bars 32 include openings 45 that have a larger upper portion 47 and a smaller lower portion 49 situated below the offset 66 as shown in FIG. 9. The embodiment shown in FIG. 13, the larger upper portion 47 is shown laterally offset with respect to the lower portion 49. The bars 32 shown in FIGS. 13 and 14 also include the mounting openings 38 and 40 as previously discussed with respect to FIGS. 2 through 9.

Figure 15:
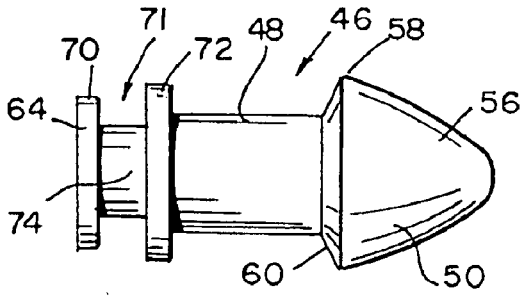
FIG. 15 is a side elevation of a peg suitable for use in connection with the bars shown in FIGS. 13 and 14.

FIG. 15 shows a peg 46 that is suitable for use in connection with the bars shown in FIGS. 13 and 14. The peg 46 of FIG. 15 includes a base 64 including a pair of flanges 70 and 72 separated by a slot 71. The rearmost flange 70 is dimension to as to be received in the larger portion 47 of opening 45. The trunk portion 74 between flange 70 and 72 is dimensioned to be received in the smaller lower portion 49 of opening 45 with flange 70 located on one side of bar 32 while flange 72 is located on the opposite side of bar 32. The peg 46 can be inserted in bar 32 so that it projects parallel to the upper portion 34 of the bar similar to that shown in FIG. 9. Alternatively, it can be inserted oppositely so that it projects away from the upper portion 34 of bar 32. This freedom of insertion of the pegs 46 is shown in FIG. 15 into the bars 32 shown in FIGS. 13 and 14 allows for accommodation of a wider variety of suspension circumstances that may be present in various curtain installation situations. The ability of the pegs 46 to move within the lower portions 49 of the openings 45 further allows for some minor variances in installation that may avoid any warping of the strips 28 forming the curtain 26.

Figure 16:
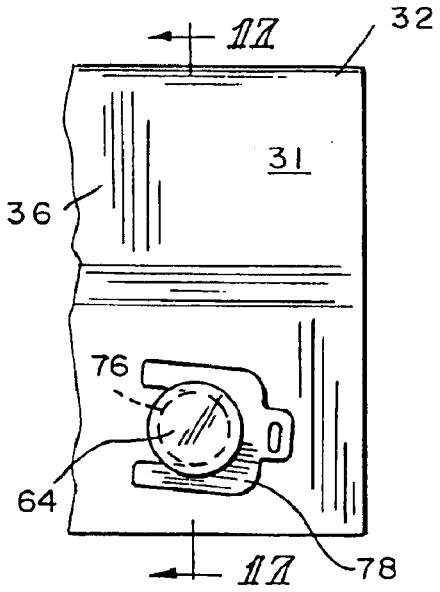
FIG. 16 is a rear elevation of a combination of a peg with another bar.
Figure 17:
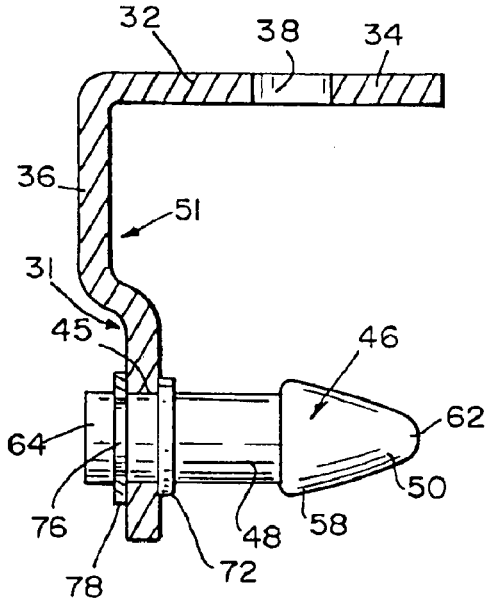
FIG. 17 is a sectional view of FIG. 16 taken through line 17—17.

FIGS. 16 and 17 show another embodiment wherein the lower vertical portion 36 of the bar 32 includes a series of round openings 45. The peg 46 of FIGS. 16 and 17 includes a base 64 including a flange 72 spaced from a slot 76 by a distance approximately equal to the thickness of the bar 32. The base 64 is sized to be received in one of the openings 45 while the flange 72 abuts the front surface 51 of the bar 32. The slot 76 is dimensioned to receive a snap ring 78 adjacent to the rear surface 31 of the bar 32 while flange 72 is located on the opposite side of bar 32, thus securing the peg 46 to the lower vertical portion 36 of the bar. The peg 46 includes a stalk portion 48 extending forward from the flange 72 and a cap portion 50, which is essentially a truncated cone extending forward from the outermost edge 58 to a distal end portion 62. The openings 38 in the upper portion 34 of the bar 32 are intended to be used to mount the bar 32 to a wall or other fixed structure adjacent to a passage sought to be protected by a strip curtain.

Figure 18:
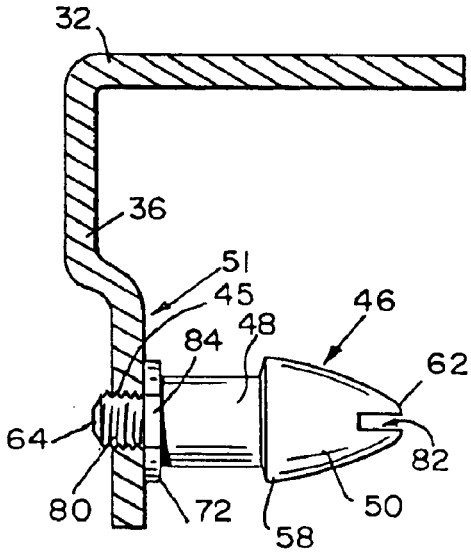
FIG. 18 is a sectional view similar to FIG. 17 of another peg and bar combination.

FIG. 18 shows another embodiment wherein the peg 46 includes a root portion 64 that includes screw threads 80. The openings 45 in the lower vertical portion 36 of the bar 32 can also include threads, or can be sized so that the insertion of the root portion 64 into the opening 45 forms threads, that conform to the threads 80 on the root portion 64. The peg 46 includes a flange 72 that abuts the front surface 51 of the lower vertical portion 36 when the threads 80 are fully engaged in the opening 45. The peg 46 includes a stalk portion 48 extending forward from the flange 72 and a cap portion 50, which is essentially a truncated cone extending forward from the outermost edge 58 to a distal end portion 62. A slot 82 is included in the distal end portion 62 of the peg 46 for receiving a driving tool for mounting the peg 46 to the bar 32. The flange 72 can also include flats 84 to facilitate use of a wrench or other tool to tighten the threads 80 in the opening 45. The peg 46 of this embodiment can be used with threaded anchors or other hole lining elements, not shown, to mount the peg 46 directly to a supporting structure adjacent to a passage through a wall, entirely omitting the use of a bar 32.

Figure 19:
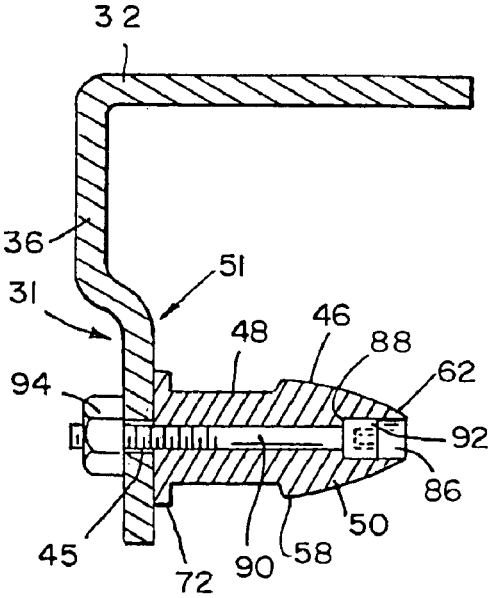
FIG. 19 is a sectional view similar to FIG. 17 of another peg and bar combination.

FIG. 19 shows yet another embodiment wherein the peg 46 comprises a flange 72 that abuts the front surface 51 of the lower vertical portion 36. The peg 46 includes a stalk portion 48 extending forward from the flange 72 and a cap portion 50, which is essentially a truncated cone extending forward from the outermost edge 58 to a distal end portion 62. An opening 86 extends axially through the peg 46 and includes a shoulder 88. A fastener 90, shown to have the form of a machine screw, extends through the axial opening 86 and has a head 92 that engages the shoulder 88. The fastener 90 can engage a threaded surface in opening 45, or more preferably engages a separate threaded nut 94 positioned against or secured to the rear surface 31 of the lower vertical portion 36. It will be appreciated that the design of the fastener 90 is subject to variation and can include a self taping screw thread or other thread that would permit direct mounting the peg 46 directly to a supporting structure adjacent to a passage through a wall, entirely omitting the use of a bar 32, with or without the use of separate anchors or hole liners.

FIGS. 20 through 25 show an embodiment wherein the openings 45 in the lower vertical portion 36 of the bar 32 are elongated or ovate. A peg 46 according to this embodiment is formed to include a rear flange 70 having a periphery 73 generally matching the shape of the opening 45, although somewhat smaller to permit the rear flange 70 to be inserted into the opening 45 as shown by the action between FIGS. 21 and 22. A forward flange 72 is provided that is generally larger than the opening 45 and includes a periphery having flats 84 that enable the peg 46 to be manipulated with a wrench or similar tool. The peg 46 includes a stalk portion 48 extending forward from the flange 72 and a cap portion 50, which is essentially a truncated cone extending forward from the outermost edge 58 to a distal end portion 62. The distal end portion 62 of the cap 50 can include one or more slots as disclosed in relation to FIG. 18.

As shown in FIG. 21, the rear flange 70 and forward flange 72 are separated by a distance S about equal to or slightly smaller than the thickness T of the lower vertical portion 36 of the bar 32. The trunk portion 74 between the two flanges 70 and 72 has a diameter no greater than the width of the rear flange 70. A forward surface 77 of the rear flange 70 includes inclined surfaces 75 that facilitate initial engagement of the rear flange 70 with the rear surface 31 of the bar 32, as shown in the series of FIGS. 22 through 24. Rotation of the peg 46 beyond the point of initial engagement, through application of a rotational torque to the flats 84 on forward flange 72, causes the flanges 72 and 74 to tighten on the opposing surfaces 31 and 51 of the lower vertical portion 36, thereby securing the peg 46 to the bar 32 as shown in FIGS. 23 and 24. Once being secured in place, the load of the strip curtain 26 under the force of gravity, coupled with the vibration that will occasionally occur as vehicles and people pass through the curtain 26, will have the tendency to lower the trunk portion 74 within the opening 45 to the position shown in FIG. 25 so that removal of the peg due merely to forces on the curtain 26 is nearly impossible The peg 46 of FIGS. 20 through 25 can be injection molded from a high strength plastic such a polyacetal, TABS, PEEK, polyamide, etc.

The strips 28 to be used with the curtain holding apparatus 22 of the present invention include a series of holes 52 near the upper margin 54 of each strip as disclosed generally in FIG. 3. The size of the holes 52 is approximately the same as the size of the stalks 48 on which the strips will be suspended. The size of the holes 52 is smaller than the largest dimension of the cap 50, which includes a distal surface 56 that is shaped to facilitate the stretching the material forming the strip 28 in the vicinity of the holes 52 to a size sufficient to permit the strip 28 to be forced over the outermost edge 58 of the caps 50 and onto the stalks 48 where the hole 52 elastically returns to its original size. By contrast, the proximal surface 60 of each of the caps 50 has a more abrupt character that can be essentially perpendicular to the stalk 48, or convex or concave or tapered so that the abrupt change in cross-section inhibits the removal of the strip curtain 26 from the pegs 46 under the conditions of normal use, but still permit forced removal in the event it becomes necessary to replace one or more of the strips 28.

From the foregoing discussion of the various illustrated embodiments of the present invention, it will be appreciated that the various aspects and characteristics of illustrated pegs can be combined with more than one of the illustrated support bars to form a variety of resulting structures all of which follow the spirit of the present invention as previously described, and as hereafter claimed.

What is claimed is:

1. An environmental strip curtain system for at least partially obstructing a passage through a wall, the system including a curtain-holding apparatus for suspending a plurality of flexible transparent strips of the curtain, each strip including a plurality of holes of a selected diameter located adjacent to an upper end of the strip, the curtain-holding apparatus comprising:

a bar, and mounting means for mounting the bar to fixed structure adjacent to said passage; and a plurality of pegs coupled to the bar, each peg including a stalk extending outwardly from the bar, each stalk having a proximal end connected to the bar and a distal end including a cap spaced by a pre-selected distance from the proximal end of each stalk, each cap being generally symmetric with respect to the stalk to which the cap is fixed, an outermost edge of the cap being ovate to circular and sized greater than said selected diameter of the holes in each strip, a distal outer surface of the cap having a dome-shaped surface extending from a distal extremity of the cap to the outermost edge of the cap facilitating the stretching of said holes of each strip to a size sufficient to permit the strip to be forced over the outermost edge of the cap.

2. An environmental strip curtain system for at least partially obstructing a passage through a wall, the system including a curtain-holding apparatus for suspending a plurality of flexible transparent strips of the curtain, each strip including a plurality of holes of a selected diameter located adjacent to an upper end of the strip, the curtain-holding apparatus comprising:

a bar, and mounting means for mounting the bar to fixed structure adjacent to said passsage; and a plurality of peas counted to the bar, each peg including a stalk extending outwardly from the bar, each stalk having a proximal end connected to the bar and a distal end including a cap spaced by a pre-selected distance from the proximal end of each stalk, each can being generally symmetric with respect to the stalk to which the cap is fixed, an outermost edge of the can being ovate to circular and sized greater than said selected diameter of the holes in each strip, a distal outer surface of each cap having a substantially conical surface extending from a distal extremity of the cap to the outermost edge of the cap facilitating the stretching of said holes of each strip to a size sufficient to permit the strip to be forced over the outermost edge of the cap.

3. An environmental strip curtain system for at least partially obstructing a passage through a wall, the system including a curtain-holding apparatus for suspending a plurality of flexible transparent strips of the curtain, each strip including a plurality of holes of a selected diameter located adjacent to an upper end of the strip, the curtain-holding apparatus comprising:

a bar, and mounting means for mounting the bar to fixed structure adjacent to said passage; and a plurality of pegs coupled to the bar, each peg including a stalk extending outwardly from the bar, each stalk having a proximal end connected to the bar and a distal end including a can spaced by a pre-selected distance from the proximal end of each stalk, each can being generally symmetric with respect to the stalk to which the cap is fixed, the outermost edge of each cap being circular and having a diameter of at least about 1.2 times said selected diameter of the holes, a distal outer surface of the can having a shape facilitating the stretching of said holes of each strin to a size sufficient to permit the strip to be forced over the outermost edge of the cap.

4. The system of claim 3 wherein the outermost edge of each cap has a diameter of about 1.5 times said selected diameter of the holes.

5. The system of claim 1 wherein the outermost edge of each cap is ovate and has a maximum dimension of at least about 1.2 times the diameter of the stalk to which the cap is fixed.

6. The system of claim 5 wherein the outermost edge of each cap has a maximum dimension of about 1.5 times the diameter of the stalk to which the cap is fixed.

7. The system of claim 1 or 2 or 3 or wherein each cap further comprises a proximal surface extending between the outermost edge of the cap and the stalk to which the cap is fixed that is planar and perpendicular to the stalk.

8. The system of claim 1 or 2 or 3 wherein each cap further comprises a proximal surface extending between the outermost edge of the cap and the stalk to which the cap is fixed that is convex.

9. The system of claim 1 or 2 or 3 wherein each cap further comprises a proximal surface extending between the outermost edge of the cap and the stalk to which the cap is fixed that is convex.

10. The system of claims 7 wherein the proximal surface of each cap is spaced from said bar by a distance at least equal to twice said strip thickness.

11. The system of any of claim 10 wherein the proximal surface of each cap is spaced from said bar by a distance equal to about five times said strip thickness.

12. The system of claim 1 or 2 or 3 wherein said proximal end of each stalk is fixed to said bar.

13. The system of claim 12 wherein said proximal end of each stalk and said bar consist essentially of a single unitary one-piece molded polymeric structure.

14. The system of claim 1 or 2 or 3 wherein said proximal end of each stalk is received in a slot in said bar.

15. The system of claim 14 wherein the slot includes an upper portion that is larger in size than a lowest portion.

16. The system of claim 15 wherein the slot includes a angular path between the larger sized portion and the lowest portion.

17. The system of claim 1 or 2 or 3 wherein said stalks are linear and perpendicular to said bar.

18. The system of claim 1 or 2 or 3 wherein said stalks are curved and generally parallel to each other.

19. The system of claim 1 or 2 or 3 wherein said stalks are cylindrical.

20. The system of claim 1 or 2 or 3 wherein said stalks are tapered.

21. A peg for use in an environmental strip curtain holding apparatus for suspending a plurality of flexible transparent strips forming a curtain, each strip including a plurality of holes of a selected diameter located adjacent to an upper end of the strip, the curtain-holding apparatus including a plurality of pegs, each peg comprising:

a stalk having a proximal end and a distal end, a cap fixed to the distal end of the stalk and spaced by a preselected distance from the proximal end of the stalk, the cap being generally symmetric with respect to the stalk, an outermost edge of the cap having a size greater than the stalk to which the cap is fixed and greater than the holes the strips to be mounted to the curtain-holding apparatus, a distal outer surface of the cap diminishing in size from the outermost edge of the cap toward a distal extremity of the cap in such a way as to facilitate the elastic stretching of said holes of each strip to a size sufficient to permit the strip to be forced over the outermost edge of the cap.

22. A peg according to claim 21 wherein the distal outer surface of the cap comprises a substantially conical surface extending from a distal extremity of the cap to the outermost edge of the cap.

23. A peg according to claim 21 wherein the distal outer surface of the cap comprises a dome-shaped surface extending from a distal extremity of the cap to the outermost edge of the cap.

24. A peg according to claim 21 wherein the outermost edge of the cap is circular and has a diameter of at least about 1.2 times said selected diameter of the holes.

25. A peg according to claim 21 wherein the outermost edge of each cap has a diameter of about 1.5 times said selected diameter of the holes.

26. A peg according to claim 21 wherein the outermost edge of the cap is ovate and has a maximum dimension of at least about 1.2 times the diameter of the stalk to which the cap is fixed.

27. A peg according to claim 26 wherein the outermost edge of the cap has a maximum dimension of about 1.5 times the diameter of the stalk to which the cap is fixed.

28. A peg according to claim 21 wherein the cap further comprises a proximal surface extending between the outermost edge of the cap and the stalk to which the cap is fixed that is planar and perpendicular to the stalk.

29. A peg according to claim 21 wherein the cap further comprises a proximal surface extending between the outermost edge of the cap and the stalk to which the cap is fixed that is concave.

30. A peg according to claim 21 wherein the cap further comprises a proximal surface extending between the outermost edge of the cap and the stalk to which the cap is fixed that is convex.

31. The peg of any of claims 28–30 wherein the proximal surface of the cap is spaced from said proximal end by a distance at least equal to twice said strip thickness.

32. The peg of any of claims 28–30 wherein the proximal surface of the cap is spaced from said proximal end by a distance equal to about five times said strip thickness.

33. A peg according to claim 21 wherein said proximal end of the stalk is fixed to a bar.

34. A peg according to claim 21 wherein said proximal end of the stalk is received in a slot in a bar.

35. A peg according to claim 21 wherein the stalk is linear.

36. A peg according to claim 21 wherein the stalk is curved.

37. A peg according to claim 21 wherein said stalk is cylindrical in cross-section.

38. A peg according to any of claims 21–30 further comprising a flange protruding outward adjacent to the proximal end of the stalk.

39. A peg according to claim 38 wherein the flange includes an edge having flats.

40. A peg according to any of claims 21–30 further comprising an axial opening through the peg between the distal and proximal ends.

41. A peg according to any of claims 21–30 further comprising a slot in the distal end for receiving a tool.

42. A peg according to claim 41 further comprising a root portion integral with the proximal end, the root portion including a threaded surface.

43. A peg according to any of claims 21–30 or 33–37 wherein the peg consists essentially of a single unitary one-piece molded polymeric structure.

44. The system of claim 8 wherein the proximal surface of each cap is spaced from said bar by a distance at least equal to twice said strip thickness.

45. The system of claim 44 wherein the proximal surface of each cap is spaced from said bar by a distance equal to about five times said strip thickness.

46. The system of claim 9 wherein the proximal surface of each cap is spaced from said bar by a distance at least equal to twice said strip thickness.

47. The system of claim 46 wherein the proximal surface of each cap is spaced from said bar by a distance equal to about five times said strip thickness.

* * * * *

UNITED STATES PATENT AND TRADEMARK OFFICE

CERTIFICATE OF CORRECTION

PATENT NO. : 7,011,132 B2
APPLICATION NO. : 10/474175
DATED : March 14, 2006
INVENTOR(S) : Robbins, III It is certified that error appears in the above-identified patent and that said Letters Patent is hereby corrected as shown below:

Column 10,
Line 17, change “peas counted” to -- pegs coupled --.
Lines 21, 23, 42, 43 and 48, change “can” to -- cap --.
Line 49, change “strin” to -- strip --.

Column 11,
Line 2, change “convex” to -- concave --.

Signed and Sealed this

Twenty-seventh Day of June, 2006

JON W. DUDAS
*Director of the United States Patent and Trademark Office*